US009777440B2

(12) United States Patent
Carney

(10) Patent No.: US 9,777,440 B2
(45) Date of Patent: Oct. 3, 2017

(54) SYSTEMS AND METHODS FOR USE IN RAIL TRACK CORRECTIONS

(71) Applicant: HARSCO CORPORATION, Camp Hill, PA (US)

(72) Inventor: Jay R. Carney, West Columbia, SC (US)

(73) Assignee: HARSCO CORPORATION, Camp Hill, PA (US)

( * ) Notice: Subject to any disclaimer, the term of this patent is extended or adjusted under 35 U.S.C. 154(b) by 369 days.

(21) Appl. No.: 14/495,335

(22) Filed: Sep. 24, 2014

(65) Prior Publication Data

US 2015/0083013 A1 Mar. 26, 2015

Related U.S. Application Data

(60) Provisional application No. 61/882,448, filed on Sep. 25, 2013.

(51) Int. Cl.

| | |
|---|---|
| ***E01B 35/00*** | (2006.01) |
| ***E01B 29/04*** | (2006.01) |
| ***E01B 35/08*** | (2006.01) |
| ***E01B 35/10*** | (2006.01) |

(52) U.S. Cl.

CPC ..... *E01B 35/00* (2013.01); *E01B 29/04* (2013.01); *E01B 35/08* (2013.01); *E01B 35/10* (2013.01)

(58) Field of Classification Search

CPC ..... E01B 35/00; E01B 35/08; E01B 35/10; E01B 29/04

See application file for complete search history.

(56) References Cited

U.S. PATENT DOCUMENTS

| | | | | |
|---|---|---|---|---|
| 3,604,117 A * | 9/1971 | Von Beckmann | E01B 35/00 | 33/287 |
| 3,706,284 A * | 12/1972 | Plasser | E01B 27/17 | 104/7.2 |
| 3,922,969 A * | 12/1975 | Tyler | E01B 33/02 | 104/8 |
| 4,040,738 A * | 8/1977 | Wagner | B61K 9/08 | 33/287 |
| 4,658,730 A * | 4/1987 | von Beckmann | E01B 33/02 | 104/7.2 |
| 4,691,565 A * | 9/1987 | Theurer | E01B 35/00 | 33/287 |

(Continued)

*Primary Examiner* — Jason C Smith

(74) *Attorney, Agent, or Firm* — Baker & McKenzie LLP

(57) ABSTRACT

Systems and methods for use in carrying out rail track corrections. A projector device is positioned on a vehicle deployed ahead of a rail maintenance vehicle and includes a Fresnel lens and a plurality of light emitting diodes arranged to provide a light beam that provides a uniform "spot." The projector device modulates the light beam in such a manner that a pair of receiver receivers disposed on the rail maintenance vehicle can detect the light source and the light intensity and frequency of wavelength of light received into each receiver of a receiver pair is substantially equal. Recorded values may be used to triangulate the geometry of the section of track being worked, while a computer compares the previous section of track already corrected to the current section and makes calculations for desired corrections to be made at work heads on the rail maintenance vehicle.

19 Claims, 11 Drawing Sheets

(56) References Cited

U.S. PATENT DOCUMENTS 5,157,840 A * 10/1992 Henttinen ..... E01B 35/04 104/7.2
5,930,904 A * 8/1999 Mualem ..... B60M 1/28 33/1 Q
6,594,910 B2 * 7/2003 Wishart ..... E04G 21/1808 33/281
6,624,899 B1 9/2003 Clark
6,767,112 B2 7/2004 Wu
6,957,905 B1 10/2005 Pritchard et al.
7,006,004 B2 2/2006 Miyashita et al.
7,024,780 B2 * 4/2006 Pfenniger ..... B66B 19/002 33/227
7,036,232 B2 5/2006 Casagrande
7,101,049 B2 * 9/2006 Shindoh ..... H04N 9/315 348/E9.027
7,192,147 B2 3/2007 Sakata et al.
7,401,925 B2 7/2008 Lu
7,410,264 B2 8/2008 Yamasaki et al.
7,499,186 B2 3/2009 Waisanen
7,602,507 B2 10/2009 Ersue et al.
7,682,041 B2 3/2010 Lin
7,744,241 B2 6/2010 Xu
7,782,516 B2 8/2010 Ito
7,918,567 B2 4/2011 Godo
7,979,995 B2 * 7/2011 Theurer ..... B61K 9/08 33/1 Q
8,393,753 B2 3/2013 Allegri
8,439,539 B2 5/2013 Yamamoto
2005/0135106 A1 6/2005 Kittelmann et al.
2008/0239726 A1 10/2008 Cheng
2010/0097802 A1 * 4/2010 Jurik ..... G02B 27/0994 362/235
2010/0309646 A1 12/2010 Morikawa et al.
2012/0087102 A1 4/2012 Baxter et al.
2013/0044478 A1 * 2/2013 Steedly ..... F21V 3/049 362/235
2013/0083531 A1 4/2013 Lui
2015/0083013 A1 * 3/2015 Carney ..... E01B 35/00 104/7.1
2016/0273172 A1 * 9/2016 Van Cleave ..... G01B 11/272

* cited by examiner

SYSTEMS AND METHODS FOR USE IN RAIL TRACK CORRECTIONS

CROSS REFERENCE TO RELATED APPLICATION

This application claims priority to U.S. Provisional Patent Application No. 61/882,448 entitled "Projector Device for Rail Applications" filed on Sep. 25, 2013, which is incorporated herein by reference in its entirety.

TECHNICAL FIELD

The present disclosure generally relates to systems and methods for use in track corrections, such as lifting, aligning, cross-leveling and/or applying geometric corrections (generally referred to as "surfacing and lining" operations) to railroad tracks.

BACKGROUND

Railroads are typically constructed to include a pair of elongated, substantially parallel rails, which are coupled to a plurality of laterally extending ties. The ties are disposed on a ballast bed of hard particulate material such as gravel. Over time, normal wear and tear on the railroad may cause the rails to deviate from a desired geometric orientation.

Rail maintenance processes for addressing such concerns typically involve the use of a tamping machine with a buggy, which cooperate with each other to provide a three-point reference system to measure the position of the track prior to applying the desired corrections to the track. A typical correction process involves lifting rail with mechanical clamps, aligning the track by shifting it to a calculated position, and then tamping the ballast under each tie to hold the track in place. This work sequence is typically repeated at each tie during the course of the correction process.

Known reference systems often utilize light beams or lasers either alone or in combination with tensioned wires. In such systems, a buggy vehicle is equipped with a light source or laser projector, a shadow board extends from the rail maintenance vehicle, and a pair of receivers, each positioned over corresponding rail, are positioned at the rear of the tamping machine.

The reference points are used to establish a geometry of the track at the particular location being worked. That is, the recorded values are used to triangulate the geometry of the section of track being worked, while an onboard computer compares the previous section of track already corrected to the current section and makes the calculations for the required corrections to be made at the work heads. Similar recording and corrections are made with four point reference systems, i.e., the recorded geometry is calculated and corrected using different formulas that result in correction of the track to a desired position.

However, known reference systems are subject to a variety of outside influences and factors that may prevent the track from being returned to the desired geometric orientation, thereby reducing the efficiency of a railroad vehicle traveling along the track. For example, the receiver pairs may be tuned to search for a specific frequency of light that may be negatively affected by ambient light (i.e., sunlight) when the buggy vehicle is spaced apart from the rail maintenance vehicle. In addition, the tensioned wires may be affected by wind and weather, may become tangled or caught, and may be difficult to keep taut. Accordingly, an improved system for use in carrying out surfacing and/or lining operations on railroad tracks is desired.

BRIEF SUMMARY

The present disclosure is directed to improved systems and methods for use in rail track corrections such as surfacing and/or lining operations on railroad track. The systems and methods may comprise a projector device positioned on a first rail vehicle and a pair of receiver devices positioned on a second rail vehicle. The projector may include a Fresnel lens and a plurality of light emitting diodes (LEDs) arranged to emit a light beam. In some embodiments, the LEDs are infrared LEDs and the Fresnel lens is replaced with a convex lens or other optical lens that cooperates with the LEDs to collimate the light source In some embodiments, the projector device may be positioned on a buggy vehicle deployed ahead of a rail maintenance vehicle, such as a tamping machine. The rail maintenance vehicle may be equipped with receiver pairs disposed on each side of the machine as well as a receiver pair disposed on top of the machine.

In practice, the projector device is activated to provide a beam that provides a uniform "spot" (i.e., a uniform beam). The light beam is then modulated in such a manner that the receivers can detect the light source. For example, the light emitted from the projector device may be modulated in a range of between about 50 Hz and 2200 Hz. In this manner, the light intensity and frequency of wavelength of light received into each receiver of a receiver pair is substantially equal. Recorded values may be used to triangulate the geometry of the section of track being worked, while a computer (e.g., disposed on the rail maintenance vehicle) compares the previous section of track already corrected to the current section and makes calculations for desired corrections to be made at work heads on the rail maintenance vehicle.

BRIEF DESCRIPTION OF THE DRAWINGS

Embodiments are illustrated by way of example in the accompanying figures, in which like reference numbers indicate similar parts, and in which.

DETAILED DESCRIPTION

While the making and using of various embodiments of the present disclosure are discussed in detail below, it should be appreciated that the present disclosure provides many applicable inventive concepts that can be embodied in a wide variety of specific contexts. The specific embodiments discussed herein are merely illustrative of specific ways to make and use the disclosure and do not limit the scope of the disclosure.

To facilitate the understanding of this disclosure, a number of terms are defined below. Terms defined herein have meanings as commonly understood by a person of ordinary skill in the areas relevant to the present disclosure. Terms such as "a", "an", and "the" are not intended to refer to only a singular entity, but include the general class of which a specific example may be used for illustration. The terminology herein is used to describe specific embodiments of the disclosure, but their usage does not limit the disclosure, except as outlined in the claims.

Various embodiments of systems and methods of rail track corrections according to the present disclosure are described. It is to be understood, however, that the following explanation is merely exemplary in describing the devices and methods of the present disclosure. Accordingly, several modifications, changes and substitutions are contemplated.

Figure 1:
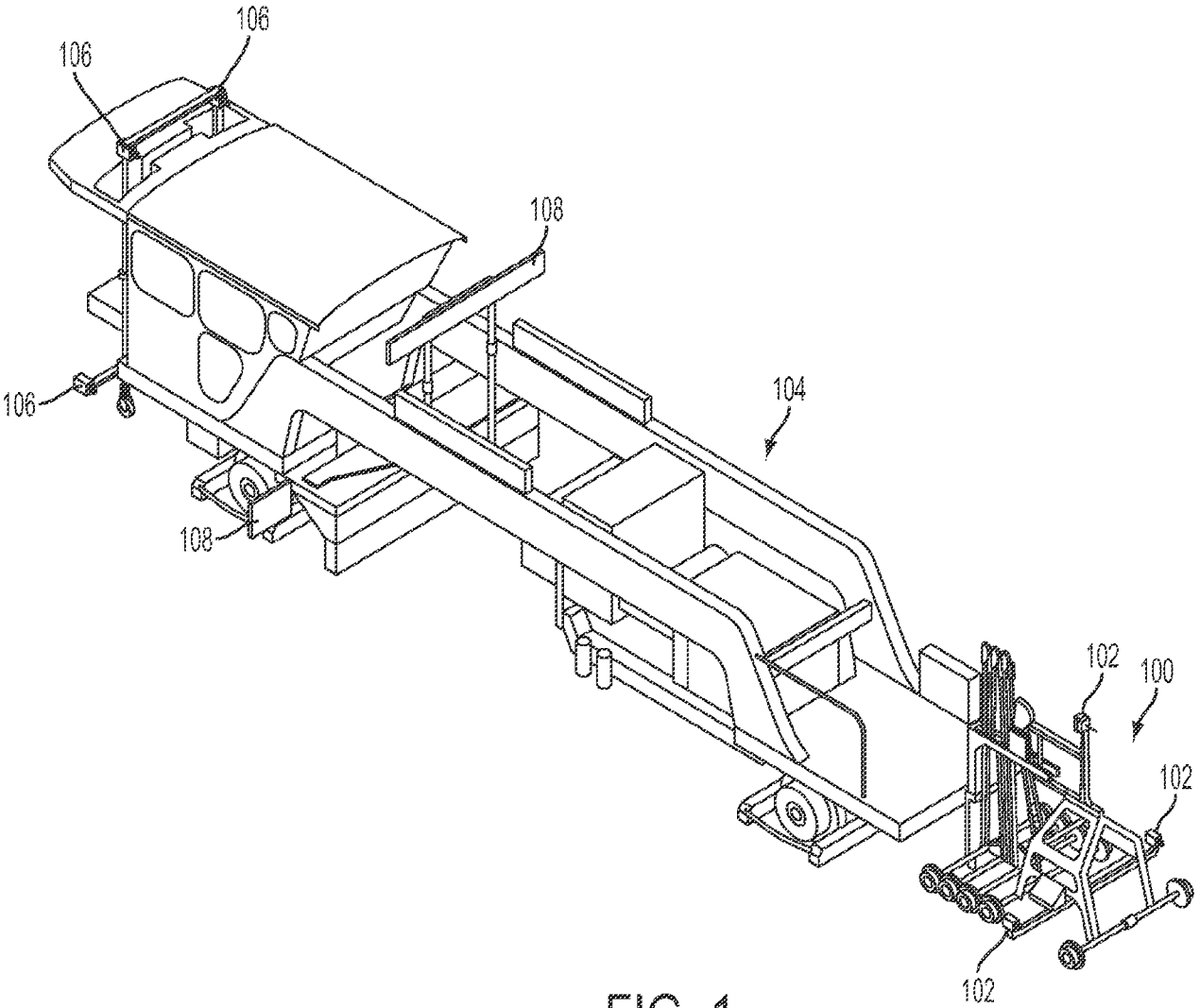
FIG. 1 illustrates a perspective view of a first rail vehicle having a projector device and a second rail vehicle having a receiver device for rail correction applications, in accordance with one embodiment of the present disclosure.
Figure 2:
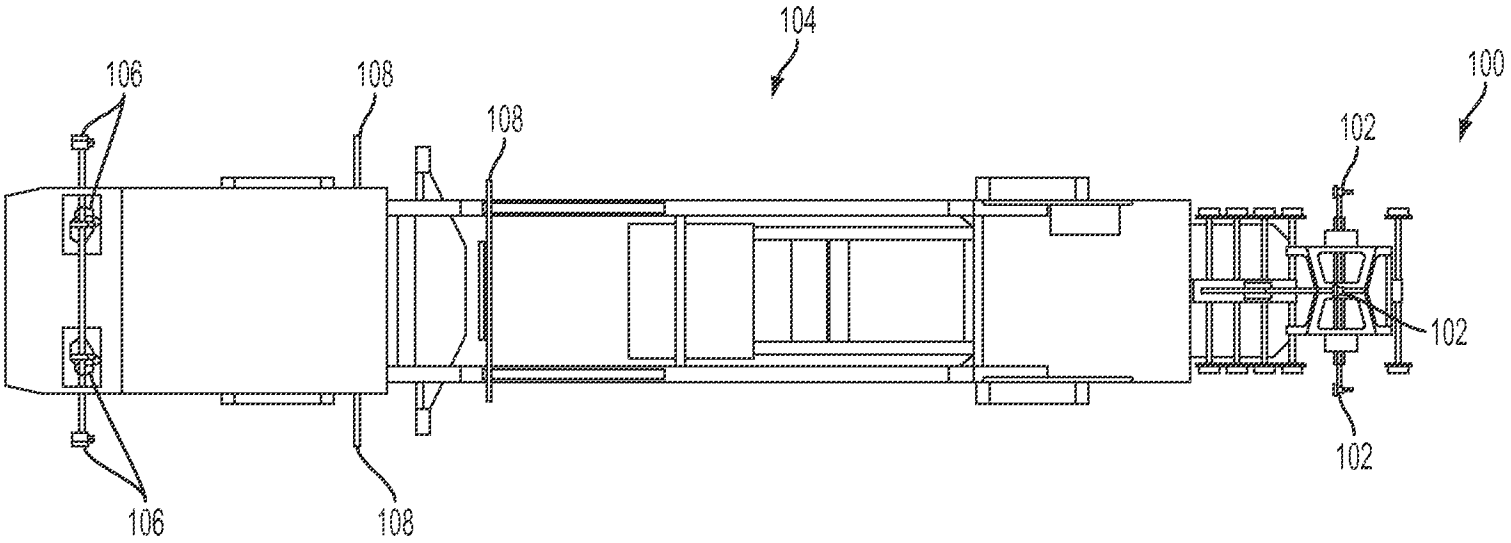
FIG. 2 illustrates a top view of the first rail vehicle and the second rail vehicle depicted in FIG. 1, in accordance with one embodiment of the present disclosure.
Figure 3:
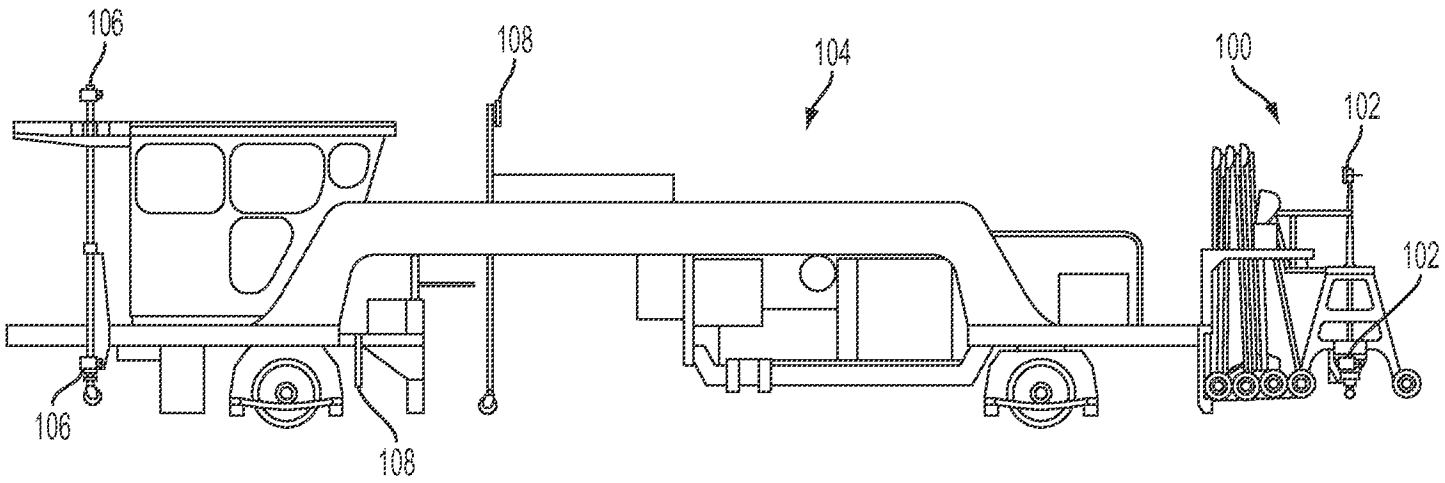
FIG. 3 illustrates a side view of the first rail vehicle and the second rail vehicle depicted in FIG. 1, in accordance with one embodiment of the present disclosure.

FIG. 1 illustrates a perspective view, FIG. 2 illustrates a top view, and FIG. 3 illustrates a side view of a first rail vehicle 100 having one or more projector devices 102 and a second rail vehicle 104 having one or more receiver devices 106 for use in rail correction applications, in accordance with one embodiment of the present disclosure. In an embodiment, the first rail vehicle 100 may comprise a buggy and the second rail vehicle 104 may comprise a tamping vehicle. The first rail vehicle 100 may be tethered to the second rail vehicle 104 or the first rail vehicle 100 may be a drone vehicle separate from the second rail vehicle 104.

The second rail vehicle 104 may further comprise one or more shadow boards 108 operable to work in conjunction with the one or more projector devices 102 and the one or more receiver devices 106. The projector devices 102, the receiver devices 106, and the shadow boards 108 may be configured for rail leveling, rail lining, or a combination of the two. In the leveling configuration, a projector device 102 may be positioned on top of the first rail vehicle 100 and a corresponding shadow board 108 and pair of receiver devices 106 may be positioned on top of the second rail vehicle 104. In the lining configuration, a projector device 102 may be positioned on either (or both) side(s) of the first rail vehicle 100, proximate to the rail, and a corresponding shadow board 108 and receiver device 106 may be positioned on the corresponding side of the second rail vehicle 104, also proximate to the rail. During operation, in both rail lining and rail leveling configurations, the first rail vehicle 100 and the one or more projector devices 102 are spaced at a distance from the second rail vehicle 104 and the one or more receiver devices 106, and the one or more shadow boards 108 are positioned between the one or more projector devices 102 and the one or more receiver devices 106. The shadow boards 108 may be located proximate to the receiver devices 106 and are operable to block a light beam emitted from one or more projector devices 102 and prevent the one or more receiver devices 106 from receiving the light beam.

Figure 4:
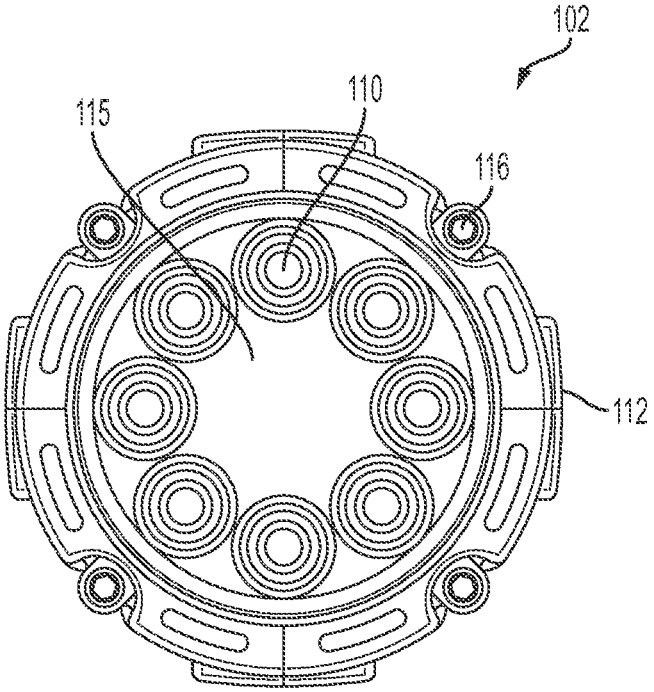
FIG. 4 illustrates a front view of the projector device of FIG. 1, in accordance with one embodiment of the present disclosure.
Figure 5:
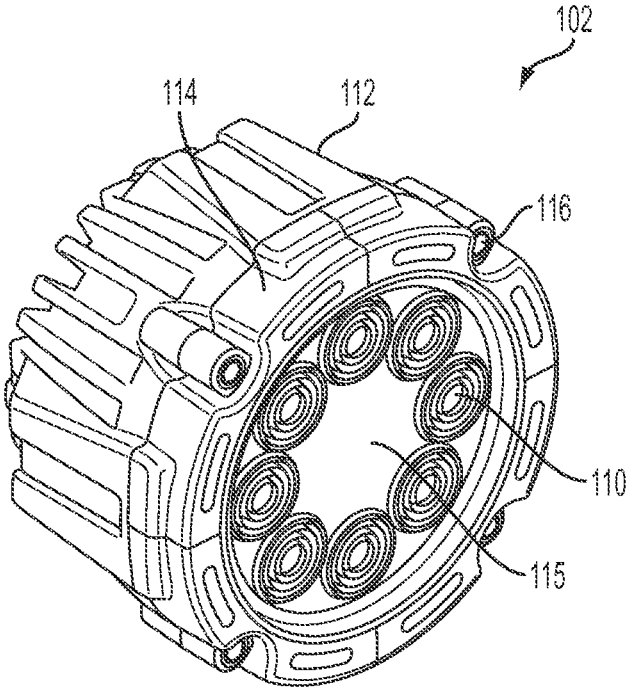
FIG. 5 illustrates a perspective view of the projector device depicted in FIG. 4, in accordance with one embodiment of the present disclosure.

FIG. 4 illustrates a front view and FIG. 5 illustrates a perspective view of the projector device 102 of FIG. 1, in accordance with one embodiment of the present disclosure. The projector device 102 may include a casing 112 and a plurality of infrared light-emitting diodes or "LEDs" 110 arranged in a circular configuration about an inner edge of the casing 112. Of course, other embodiments are contemplated in which the LEDs 110 are arranged in other configurations, such as rectangular or square configurations. Also, other types of LEDs may be employed other than infrared LEDs. The LEDs 110 are positioned within the casing 112 having a detachable face 114. The detachable face 114 may be secured to the casing 112 via connectors 116, such as threaded screws. The detachable face 114 further comprises a lens 115 disposed over the LEDs 110 for generating the desired light beam. In some embodiments, the lens 115 may be a Fresnel lens, a convex lens, or lens of another shape that collimates the light source. The LEDs 110 and the lens 115 may be housed in a removable lens casing 117.

Figure 6:
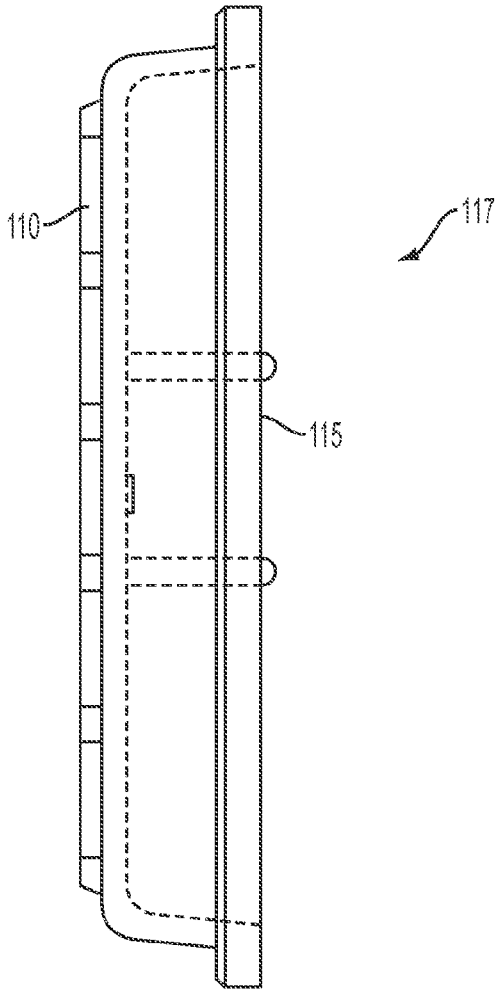
FIG. 6 illustrates a side view of a lens casing of the projector device of FIG. 1, in accordance with one embodiment of the present disclosure.
Figure 7:
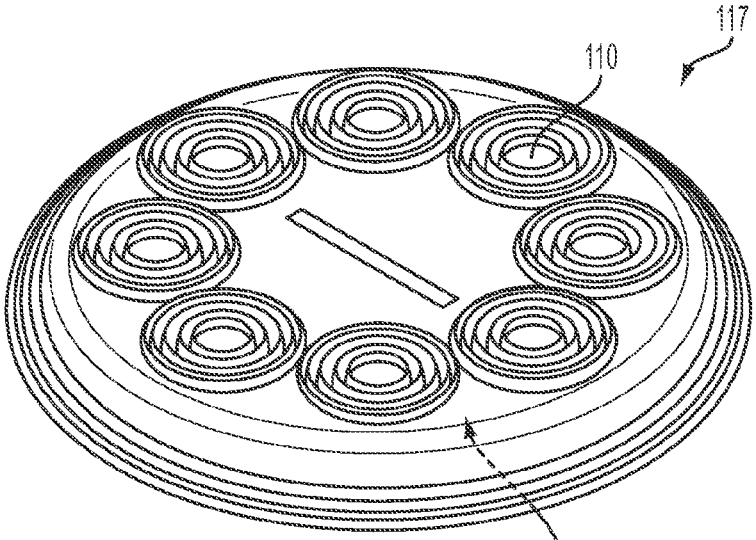
FIG. 7 illustrates a perspective view of the lens casing depicted in FIG. 6, in accordance with one embodiment of the present disclosure.

FIG. 6 illustrates a side view and FIG. 7 illustrates a perspective view of the lens casing 117 of the projector device of FIG. 1, in accordance with one embodiment of the present disclosure. The lens casing 117 houses the lens 115 and the LEDs 110. The lens 115 used according to the present disclosure may be thin (e.g., between about 0.2 and 0.3 inches) and may be adapted to produce a substantially uniform light source. The combination of the circular array of LEDs and the lens creates a homogenous light "spot," regardless of the number of individual LEDs used in the array.

Figure 8:
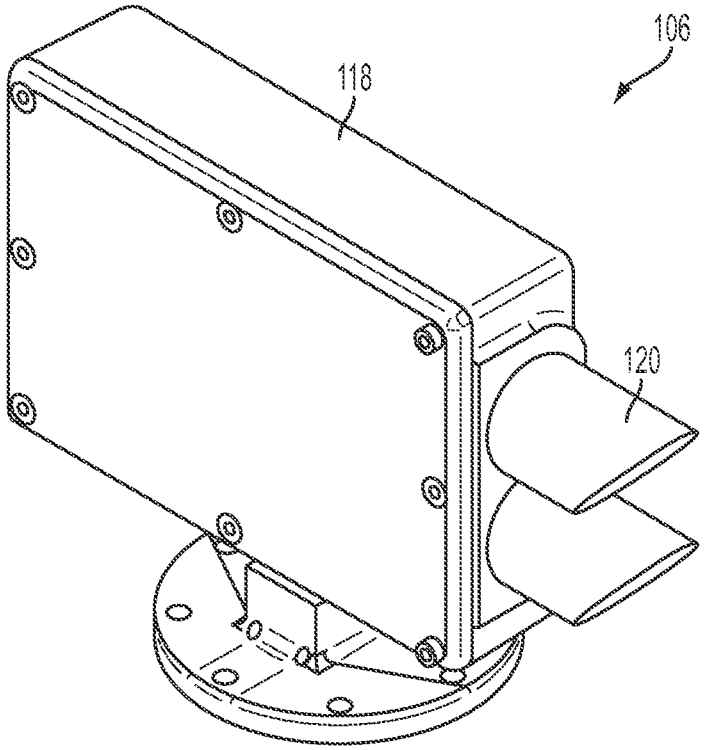
FIG. 8 illustrates a perspective view of the receiver device depicted in FIG. 1, in accordance with one embodiment of the present disclosure.

FIG. 8 illustrates a perspective view of the receiver device 106 depicted in FIG. 1, in accordance with one embodiment of the present disclosure. The receiver device may comprise a housing 118 and one or more optical lenses 120 positioned about the housing 118 and one or more optical filters positioned proximate to and behind the optical lenses 120. The optical lenses 120 may be optimized for a desired range of light intensity and frequency of wavelength of light, e.g., near infrared or infrared light. In an embodiment, each receiver device 106 may comprise two optical lenses 120 operable to receive lights from the projectors and convert the light into an electrical system that may be directed to a computerized control system. In an embodiment, the receiver device 106 may be positioned on the second rail vehicle in either a substantially vertical orientation on top of the second rail vehicle for leveling operations or in a substantially horizontal orientation on the sides of the second rail vehicle for lining operations.

Figure 9:
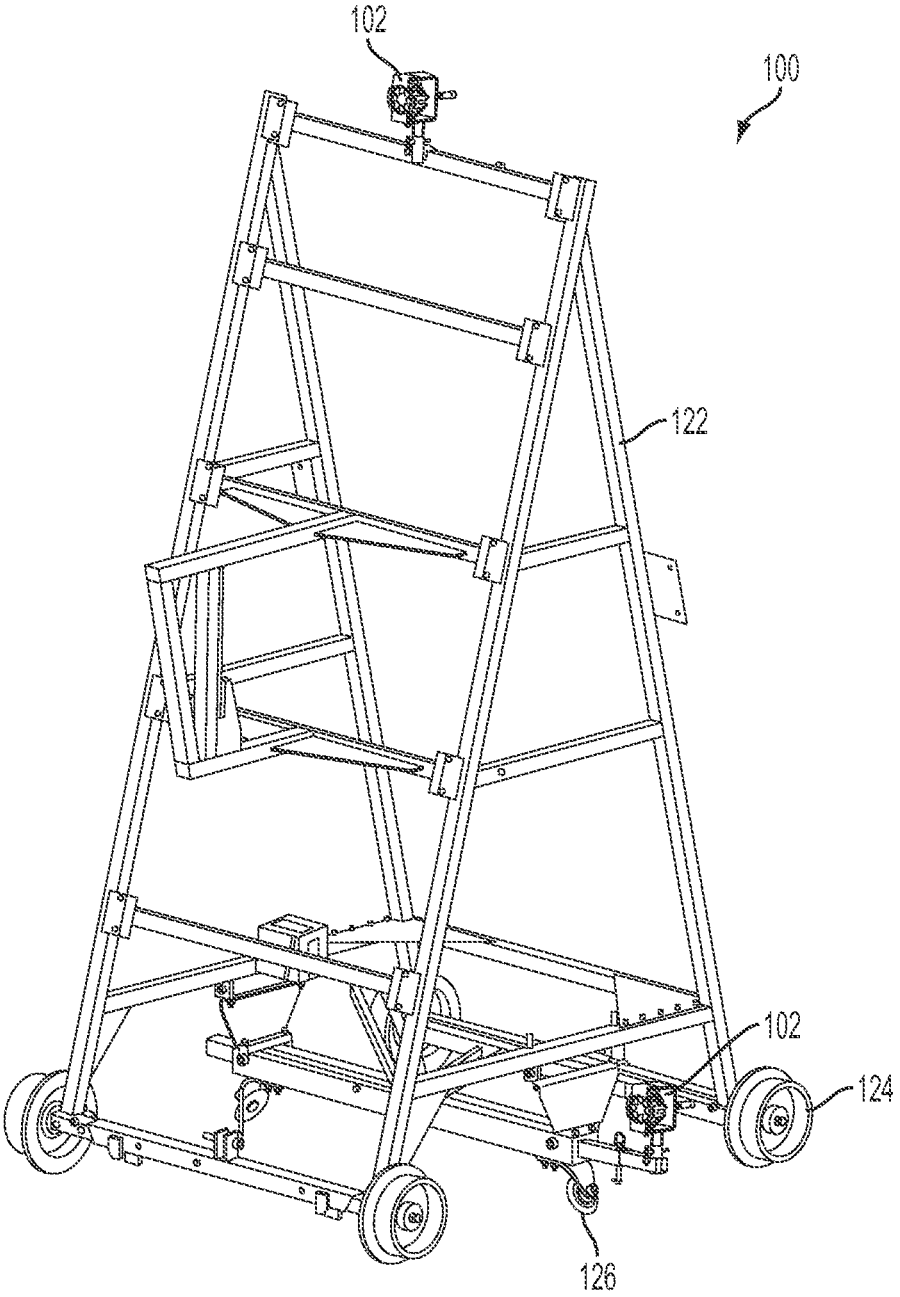
FIG. 9 illustrates a perspective view of the first rail vehicle and a plurality of projectors, in accordance with one embodiment of the present disclosure.

FIG. 9 illustrates a perspective view of the first rail vehicle 100 and a plurality of projectors 102, in accordance with one embodiment of the present disclosure. In an embodiment, the first rail vehicle 100 may comprise a frame structure 122 that extends from proximate to the rails upward to a height substantially equal to a height of the second rail vehicle. In an embodiment, a projector device 102 may be positioned on top of the first rail vehicle 100 for leveling operations.

The frame structure 122 may comprise a plurality of wheels 124 that allow the first rail vehicle 100 to move along the rail. The frame structure 122 may further comprise a lining projector carrier 126 operable to extend below the frame structure 122 and travel along the rail independently of the plurality of wheels 124. The lining projector carrier 126 may be operable to receive one or more projector devices 102, and the one or more projector devices 102 may be extended outwardly from the frame structure 122. In an embodiment, one or more projector devices 102 may be positioned on the sides of the first rail vehicle 100 for lining operations.

Figure 10:
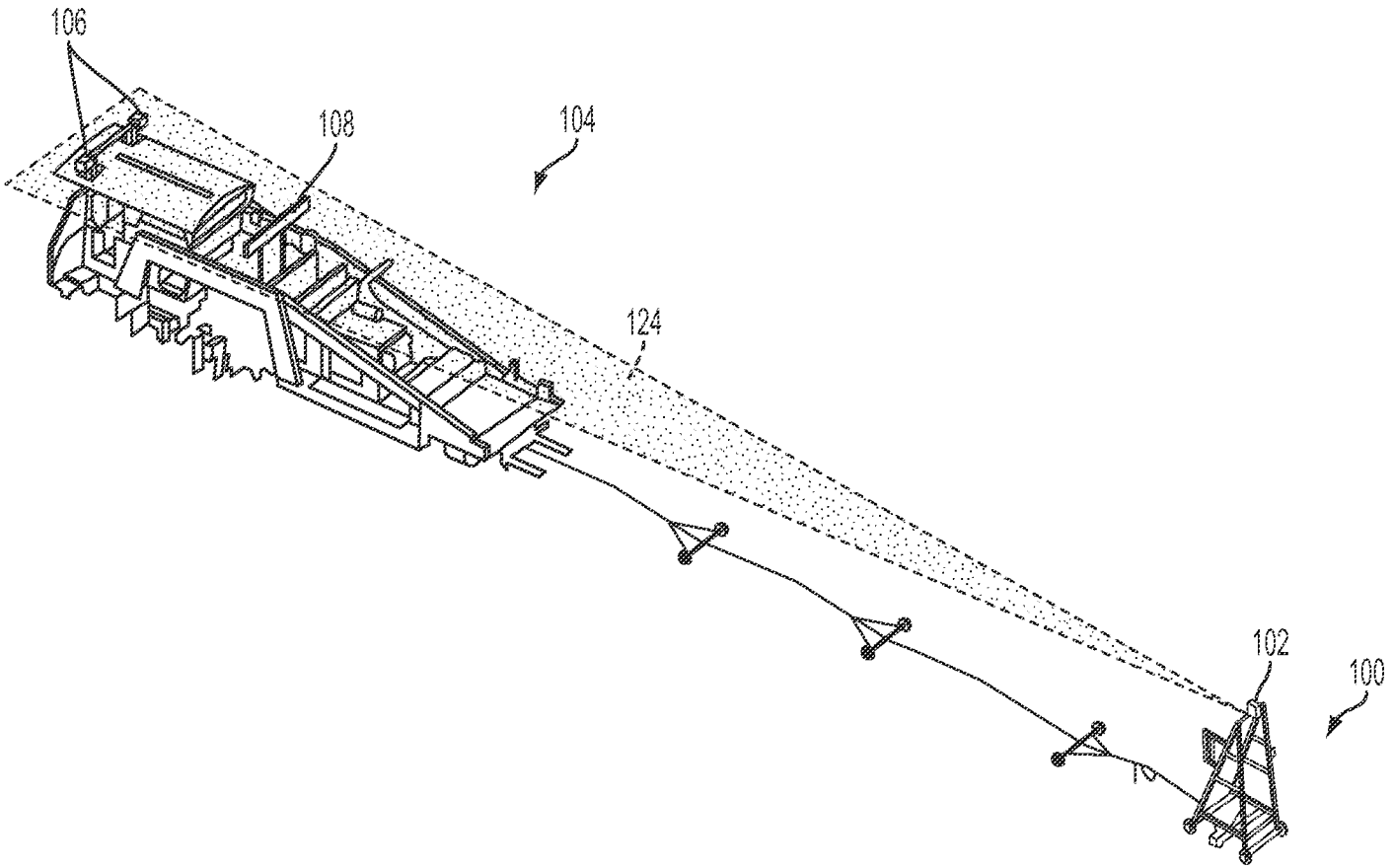
FIG. 10 illustrates a perspective view of the first rail vehicle having the projector device and the second rail vehicle having the receiver device in operation, in accordance with one embodiment of the present disclosure.
Figure 11:
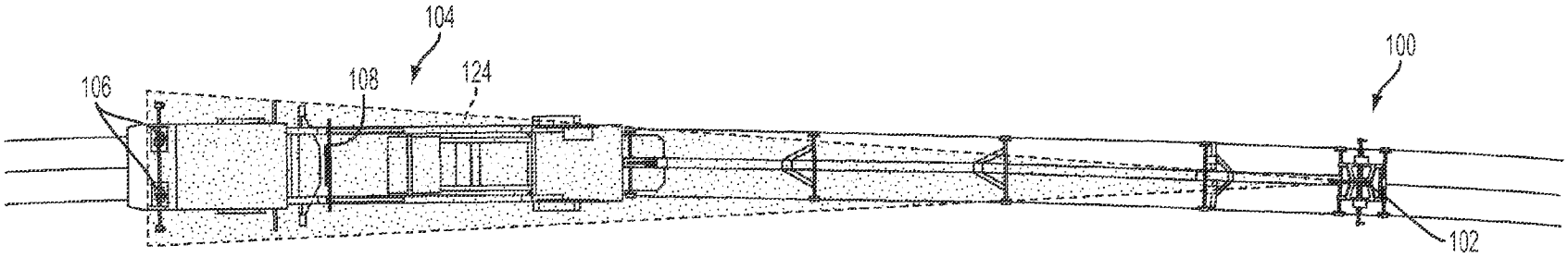
FIG. 11 illustrates a top view of the first rail vehicle having the projector device and the second rail vehicle having the receiver device in operation, in accordance with one embodiment of the present disclosure.
Figure 12:
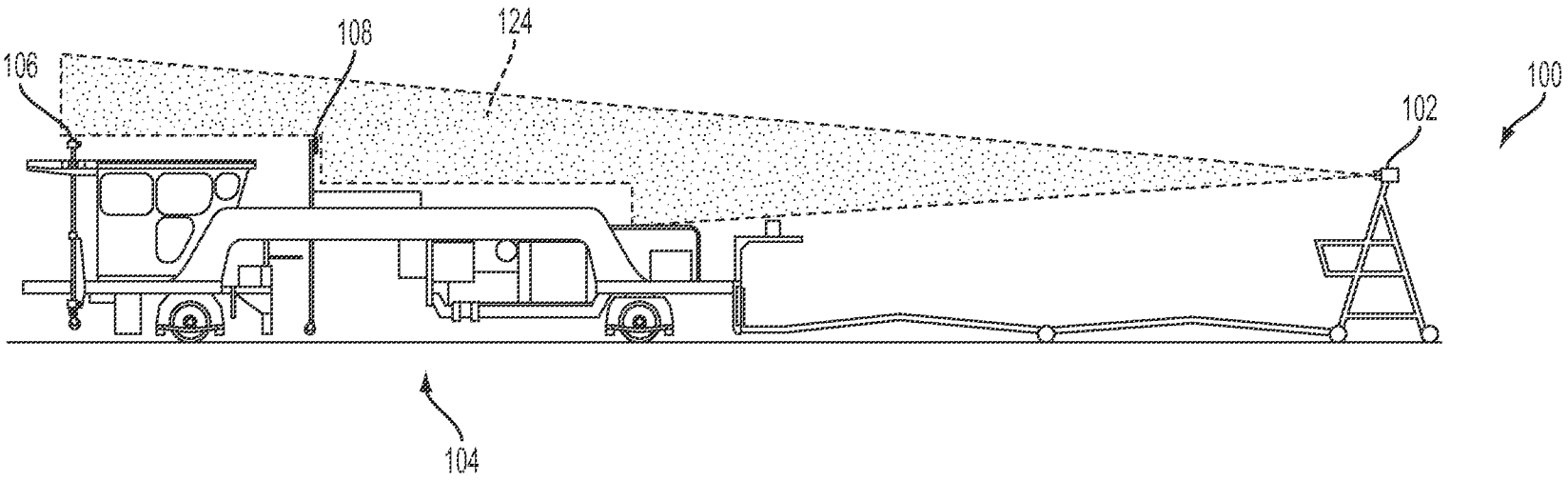
FIG. 12 illustrates a side view of the first rail vehicle having the projector device and the second rail vehicle having the receiver device in operation, in accordance with one embodiment of the present disclosure.

FIG. 10 illustrates a perspective view, FIG. 11 illustrates a top view, and FIG. 12 illustrates a side view of the first rail vehicle 100 distant from the second rail vehicle 104, in accordance with one embodiment of the present disclosure. As shown in FIG. 10, the first rail vehicle 100 and the second rail vehicle 104 may be configured for both lining and leveling operations.

In operation, the one or more projector devices 102 may be positioned on the first rail vehicle 100, i.e., the buggy vehicle, deployed ahead of the second rail vehicle 104, i.e., a rail maintenance vehicle, such as a tamper vehicle. The buggy vehicle may be tethered to the rail maintenance vehicle, or in some embodiments, the buggy vehicle may operate as a drone vehicle (i.e., untethered from the rail maintenance vehicle). The first rail vehicle 100 and the second rail vehicle 104 may be spaced 40' to 200' or more apart from each other during lining and leveling operations. The light source generated by the one or more projector devices 102 may be received at one or more receiver devices 104 disposed substantially adjacent to one another (i.e., a "receiver pair"). In some embodiments, additional receiver device 104 pairs are disposed at different points along the second rail vehicle 104, e.g., a first receiver device 106 pair disposed on a first side of the tamper vehicle, a second receiver device 106 pair disposed on a second side of the tamper vehicle, and third and fourth receiver device 106 pairs disposed at a top of the tamper vehicle. In some embodiments, lining operations may only require one receiver device 106 per projector device 102, while leveling operations may require two receiver devices 106 per projector device 102.

The one or more projector devices 102 may be adapted to produce a uniform light source 124 resulting in a uniform "spot" such that the light intensity received into each receiver device 106 of a receiver pair is substantially equal. That is, each receiver device 106 of a receiver pair is adapted to receive substantially the same intensity of light 124. In addition, the light source 124 is modulated in such a manner that each receiver device 106 of a receiver pair can detect the light source 124. In this manner, the light source 124 has a predefined signature, which is detected by each receiver device 106 of a receiver pair. In some embodiments, the receiver pair may be tuned to work with a range of frequency and wavelength, e.g., substantially between 50 Hz and 2200 Hz. Accordingly, upon activation of the projector device 102 and receipt of the light source 124 at the receiver device 106, the system of the present disclosure may recognize such light 124 as being emitted by the projector device 102 due to the amount of frequency and intensity of the light source. This is helpful for purposes of excluding other light sources, such as ambient light sources.

In some embodiments, the rail maintenance vehicle may be equipped with a plurality (e.g., three) shadow boards 108 generally positioned at an area adjacent to one or more work heads, such as linear actuators. In a surfacing operation, the track is lifted via clamps and actuators until the top shadow board 108 shields the light beam 124 emitted from the projector device 102 and the light 124 is not received at a pair of corresponding receiver devices 106. Jacking/lifting would occur at the actuators until the shadow board 108 intersects the infrared light beam 124. At this time, the lifting ceases while the work heads tamp the particular tie being worked upon. The total lift that is applied to the track may be controlled by changing the position of receiver device 106. The position may be changed manually by using an up/down button on an operator keypad or automatically by a computer controlled surface ramp. Likewise, lining operations may also be performed in which the amount of correction is determined by the laterally placed (i.e., side) shadow boards 108 shielding the light beam 124 from reaching receiver device 106 pairs laterally disposed on the rail maintenance vehicle.

Figure 13:
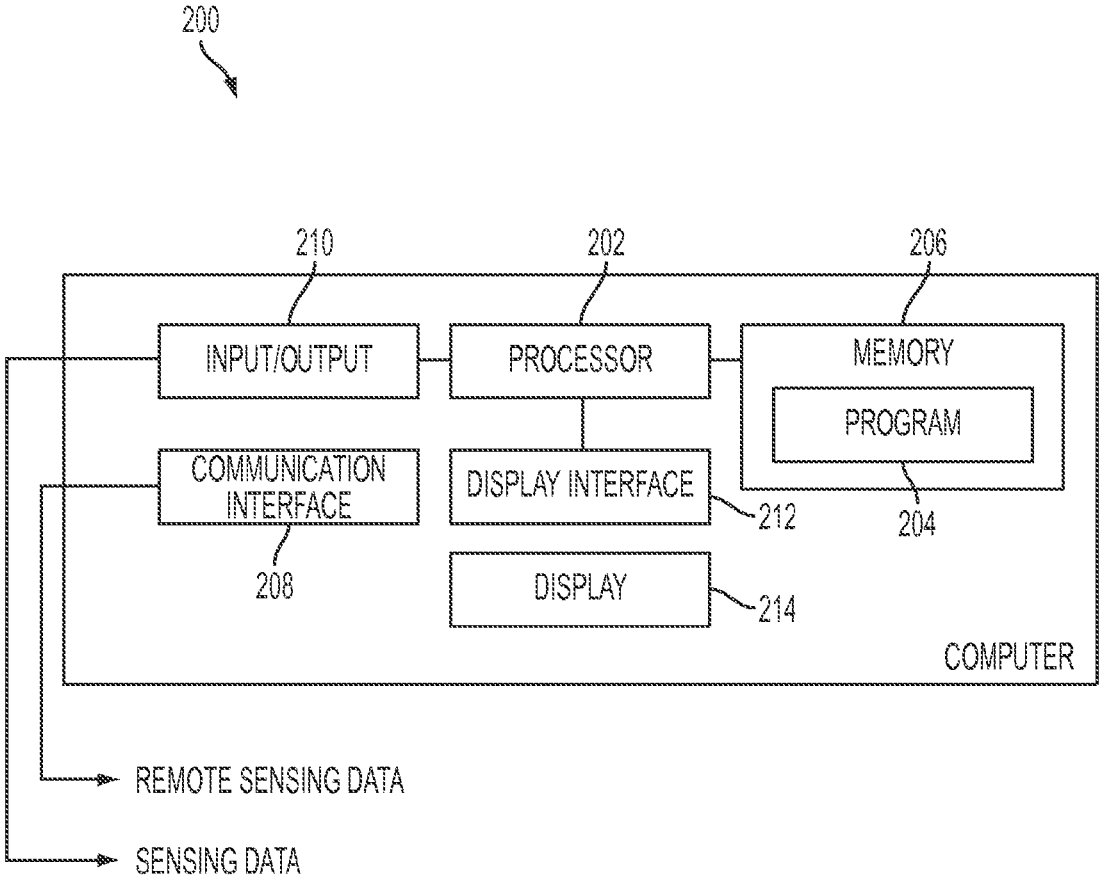
FIG. 13 illustrates a data processing system for carrying out methods according to one embodiment of the present disclosure.

FIG. 13 illustrates a data processing system 200 for carrying out methods according to one embodiment of the present disclosure. The data processing system 200 may include a processor 202 configured to execute at least one program 204 stored in a memory 206 for the purposes of processing data to perform one or more of the techniques that are described herein. The processor 202 may be coupled to a communication interface 208 to receive remote sensing data. The processor 202 may also receive the sensing data via an input/output block 210. In addition to storing instructions for the program, the memory 206 may store preliminary, intermediate, and final datasets involved in the techniques that are described herein. Among its other features, the computer or data processing system 200 may also include a display interface 212 and a display 214 that displays the various data that is generated as described herein. It will be appreciated that the computer or data processing system 200 shown in FIG. 12 is merely exemplary (for example, the display may be separate from the computer, omitted, etc.) in nature and is not limiting of the systems and methods described herein.

While various embodiments in accordance with the principles disclosed herein have been described above, it should be understood that they have been presented by way of example only, and are not limiting. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

It will be understood that the principal features of this disclosure can be employed in various embodiments without departing from the scope of the disclosure. Those skilled in the art will recognize, or be able to ascertain using no more than routine experimentation, numerous equivalents to the specific procedures described herein. Such equivalents are considered to be within the scope of this disclosure and are covered by the claims.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Field of Invention," such claims should not be limited by the language under this heading to describe the so-called technical field. Further, a description of technology in the "Background of the Invention" section is not to be construed as an admission that technology is prior art to any invention(s) in this disclosure. Neither is the "Summary" to be considered a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12 or 15%.

The term "or combinations thereof" as used herein refers to all permutations and combinations of the listed items preceding the term. For example, "A, B, C, or combinations thereof is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and/or methods and in the steps or in the sequence of steps of the method described herein without departing from the concept, spirit and scope of the disclosure. All such similar substitutes and modifications apparent to those skilled in the art are deemed to be within the spirit, scope and concept of the disclosure as defined by the appended claims.

What is claimed is:

1. A system for use in rail track correction, comprising:

a projector device positioned on a first rail vehicle, the projector device having a plurality of LEDs disposed adjacent to a lens wherein the projector device is adapted to emit a light beam having an intensity, and further wherein the light beam is modulated;

a receiver device disposed on a second rail vehicle, the receiver device comprising a pair of receivers disposed substantially adjacent to one another, wherein each receiver of the pair of receivers is adapted to receive light of substantially equal intensity and frequency from the projector device; and a shadow board disposed on the second rail vehicle, wherein the shadow board is operable to block the light emitted from the projector device.

2. The system of claim 1, wherein the second rail vehicle further comprises one or more work heads operable to lift a section of track during lining and leveling operations.

3. The system of claim 2, wherein when each receiver of the pair of receivers receives light from the projector device, the one or more work heads lift and level the section of track.

4. The system of claim 2, wherein when the shadow board blocks the light emitted from the projector from being received by each receiver of the pair of receivers, the one or more work heads do not lift or level the section of track.

5. The system of claim 1, wherein the LEDs are arranged in a circular configuration within the projector device.

6. The system of claim 1, wherein the light emitted from the projector device may be modulated in a range of between about 50 Hz and 2200 Hz.

7. The system of claim 1, wherein each receiver of the pair of receivers comprises one or more optical lenses and one or more optical filters positioned proximate to the optical lenses.

8. The system according to claim 7, wherein the light intensity and frequency of wavelength of light received into each receiver of the pair of receivers may be in a range of between about 50 Hz and 2200 Hz.

9. The system according to claim 8, wherein the light intensity and frequency of wavelength of light received into each receiver of the pair of receivers is substantially equal.

10. The system according to claim 1, wherein the first rail vehicle and the second rail vehicle are spaced approximately 40' to 200' apart from each other.

11. A method for use in rail track corrections, the method comprising:

providing a projector device on a first rail vehicle, the projector device having a plurality of LEDs disposed adjacent to a lens;

providing a receiver device on a second rail vehicle, the receiver device comprising a pair of receivers disposed substantially adjacent to one another;

emitting a modulated light beam having an intensity from the projector device;

receiving light of substantially equal intensity and frequency at each receiver of the pair of receivers;

triangulating a geometry of a section of track being worked; and comparing the geometry of the section of track being worked with a geometry of a previous section of track.

12. The method of claim 11, further comprising providing a shadow board on the second rail vehicle, wherein the shadow board is operable to block the light emitted from the projector device.

13. The method of claim 12, wherein the second rail vehicle further comprises one or more work heads operable to lift a section of track during lining and leveling operations.

14. The method of claim 13, wherein when each receiver of the pair of receivers receives light from the projector device, the one or more work heads lift and level the section of track.

15. The method of claim 13, wherein when the shadow board blocks the light emitted from the projector from being received by each receiver of the pair of receivers, the one or more work heads do not lift or level the section of track.

16. The method according to claim 11, wherein the emitted light may be modulated in a range of between about 50 Hz and 2200 Hz.

17. The method according to claim 16, wherein the light intensity and frequency of wavelength of light received into each receiver of the pair of receivers may be in a range of between about 50 Hz and 2200 Hz.

18. The method according to claim 17, wherein the light intensity and frequency of wavelength of light received into each receiver of the pair of receivers is substantially equal.

19. The method according to claim 11, further comprising spacing the first rail vehicle approximately 40' to 200' apart from the second rail vehicle.

* * * * *